US007083513B2

(12) United States Patent
Bisson

(10) Patent No.: US 7,083,513 B2
(45) Date of Patent: Aug. 1, 2006

(54) PORTABLE VENTILATOR FOR WORK STATION

(76) Inventor: William M. Bisson, 12609 E. Main, Spokane, WA (US) 99216

( * ) Notice: Subject to any disclaimer, the term of this patent is extended or adjusted under 35 U.S.C. 154(b) by 0 days.

(21) Appl. No.: 10/847,031

(22) Filed: May 17, 2004

(65) Prior Publication Data

US 2005/0272363 A1 Dec. 8, 2005

(51) Int. Cl.
*B08B 15/04* (2006.01)

(52) U.S. Cl. ..... 454/67; 454/65

(58) Field of Classification Search ..... 454/63, 454/64, 65, 67, 344
See application file for complete search history.

(56) References Cited

U.S. PATENT DOCUMENTS 254,582 A * 3/1882 Abele ..... 432/65
536,097 A * 3/1895 Reading ..... 126/242
3,469,566 A * 9/1969 Wilkinson et al. ..... 60/317
3,605,396 A * 9/1971 Guignard et al. ..... 57/279
5,113,750 A * 5/1992 Sherman ..... 454/63
5,702,493 A * 12/1997 Everetts et al. ..... 55/356

* cited by examiner

*Primary Examiner*—Gregory Wilson
(74) *Attorney, Agent, or Firm*—Keith S. Bergman; William A. Jeckle

(57) ABSTRACT

A portable ventilator for removing deleterious gasses from a welding site provides a funnel-like collection head structurally carried by an electrically non-conductive rigid dispersement tube carrying a powering structure. The powering structure provides pressurized gas from an external source through an adjustment valve to an input nozzle carried in axial alignment in the channel defined by the dispersement tube spacedly adjacent the joinder of the collection head with the dispersement tube to output pressurized gas toward the distal output end of the dispersement tube.

5 Claims, 2 Drawing Sheets

PORTABLE VENTILATOR FOR WORK STATION

BACKGROUND OF INVENTION

Related Applications

There are no applications related hereto heretofore filed in this or any foreign country.

Field of Invention

The instant invention relates generally to ventilators that extract fumes from work stations such as welding sites and more particularly to such devices that are portable for field work especially such as welding sites on or about railroad tracks in place.

Background and Description of Prior Art

Various industrial processes generate deleterious fumes, which must be dealt with to protect workers in or at the sites of the processes. Welding processes present particular problems of this type because the high temperatures involved and various materials used in the process such as fluxes, oxidation inhibiting agents and the like produce gaseous by-products that may be injurious to the health of workers at or about a welding site. The problem has long been recognized and in the present day has become sufficiently significant that various governmental authorities have been established to oversee and regulate the problem.

In established permanent industrial areas where welding is carried out fumes can be controlled by relatively permanent and sophisticated mechanisms that remove the deleterious fumes from the area for replacement by ambient atmosphere or process the fumes to remove or at least attenuate their environmentally adverse impact. Dealing with fumes in on-sight field type welding operations, however, is quite different and creates more complex problems. For field use, ventilator or fume extractor systems must have portability and generally may not have complex or overly sophisticated apparatus or processes to modify the deleterious products exhausted by the systems.

Portable ventilator systems for field use at welding sites on or about railroad tracks present additional problems by reason of the environment in which they are used and though ventilators have heretofore become known for such purpose various problems still remain with such systems. The instant ventilator seeks to resolve various of these remaining problems while yet providing a ventilator which may well and effectively be used in other environments requiring use of such a device.

Railroads for safety purposes have long used electric current carried by the opposed metallic rails of a track system to indicate the presence or absence of one or more trains within portions of the track system by providing signaling devices operated by a low amperage, relatively low voltage, direct current circuit carried through various adjacent portions of the track system known as "blocks". A plurality of blocks is sequentially interconnected with adjoining blocks in series type electrical interconnection to form an "interlocking closed track system". The electric current in each block operates signaling devices along its track forming the electric circuit in the block and transmits data indicating block condition to distant control operations and trains using the interlocking closed track system.

In a modern interlocking closed track system, a power supply is located at one end of a block and a relay is located at the other end of the block. A train entering the block shorts both the relay and the power supply with its steel wheels and interconnecting axles to cause the relay to open to responsively indicate that the block is occupied by a train or similar rail vehicle. Failure of any component in the system breaks the circuit to indicate that the block is occupied to provide a fail-safe system stopping further traffic until the failure is corrected.

In modern track systems rails are formed of electrically conductive steel and usually have substantial lengths of one-quarter to one-half mile or possibly more. A plurality of rail segments are commonly welded together at their adjoining ends to form continuous tracks of any desired length. If the adjoining rail ends are not welded, and in some instances even where they are welded, the track ends are electrically connected to each another by copper straps and fasteners collectively called "bonds" to ensure electrical conductivity. One end of each copper strap commonly is secured to one end of each adjoined rail by bolting.

In maintaining track systems it is often necessary to weld on the system rails while the block signal system associated with the rails is operative. Typically rail welding is accomplished by an electrical arc, which uses high amperage current at a medial voltage that is transmitted through one rail to a welding electrode nearby to institute the welding arc. During this process if the rail carrying the high amperage welding current is inadvertently shorted to the opposed rail, the welding current may be transmitted through the block signal circuitry to cause catastrophic damage to the low voltage low, amperage signaling system which can be expensive to repair or replace and cause a shutdown of the particular block or possibly the entire interlocking closed track circuit until repairs are made. By reason of this problem a ventilator used about track system welding sites to be practically operative must provide some means or method for preventing the extractor from being the instrumentality by which shorting between rails might accidentally occur. In the instant ventilator, which is of an elongate nature with length that may be sufficient to extend between two opposed rails of a track, it has been found that most if not all of the device may be formed of electrically non-conductive plastic material arranged in such fashion in relation to conductive material as to prevent the passage of any electric current through the ventilator or between adjacent rails.

Welding processes in general and particularly electric arc welding, use fluxes of various sorts which when heated to welding temperatures form substantial quantities of gasses which may be quite deleterious to human health and must therefore be moved away from workmen in the area of a welding site for worker safety and to comply with various governmental, employment and health regulations. The most common method of protecting such workmen in the past, and especially the welder, has been to use semi-enclosed welding helmets having an associated eye protecting device and a ventilating system. The known welding helmets, however, do not adequately resolve the ventilating problem as firstly, the deleterious gasses may be brought into the containment space about the head of a welder and may cause substantial worker damage before exhaustion. Secondly, depending upon the area of exhaustion of the gasses from the helmet, the exhausted gasses may re-enter the helmet space. Such welding helmets also generally do not protect any workers in the welding area except the welder. Ventilated welding helmets also are expensive, increase the mass of the helmet, and make it more uncomfortable for use by a worker. Commonly welding helmets with ventilating systems are operated by an electrically powered fan type device, but in field areas electrical power may be unavailable or difficult to obtain in commonly required current ranges.

My ventilator resolves various of these problems by providing a device of an elongate tubular nature having a metallic funnel-like input structure carried by an elongate plastic exhaust pipe which is electrically non-conductive to allow slag and metal particles that may be thermally active to be received in the metallic input structure while exhausting deleterious gaseous material through the output orifice distant from the welding site without any possibility of the device creating an electrically conductive path between the opposed rails of a track system. The ventilator is powered by introducing a stream of high-pressure air into the radially medial portion of the exhaust channel at or spacedly near the joinder of the exhaust pipe with the input structure. Pressurized air is used to power the ventilator as a source of pressurized air is available at most welding sites, and especially railway welding sites, to power other tools there used. Use of pressurized air for such powering eliminates the possibility of electrical shorting between the rails of a block signal system by accidents involving current from an electrically powered fan and eliminates the potentiality of additional contamination about a welding site such as may result from fossil fuel powered motors that may be required to directly or indirectly power a fan type device. The use of pressurized air also allows direct powering of the ventilator mechanism without additional apparatus such as fans, turbines or the like that would be required to move gasses and requires no moving parts that wear or require maintenance.

My ventilator provides a sturdy compact light weight device that may be readily manually manipulated by a workman for proper positioning and orientation to disperse deleterious gasses from an open field welding site at a distance from the site and in an orientation consistent with local prevailing winds for effective removal from the welding site and from about the welder. The ventilator is also sufficiently manipulable and has high enough air flow therethrough that it may be oriented with its output end adjacent a welding site to blow ash, slag, metallic particles and similar smaller debris from about the welding site when necessary.

Various devices to remove welding gasses from a welding site have heretofore become known. These known devices may be divided into a first class having motor driven fan or turbine mechanisms to move welding fumes and a second class, which uses pressurized gas to move the fumes for exhaustion distally from the welding site. Devices of the first class are distinguished from those of the second class by reason of their required motors and air moving mechanisms, both with their inheritant infirmities and which are not required in devices of the second class. The instant ventilator is a member of the second class that resolves problems that have not been resolved by its classmates.

Most members of the second class of ventilators have not been particularly concerned with efficient use of pressurized air to maximize fume extraction. Several devices of the second class have provided exhaust channels formed of flexible tubing having annular accordion type folds orientated perpendicularly to their exhaust channel axis or have introduced pressurized gas adjacent to a tubular surface defining the exhaust channel, either of which tend to increase fluid friction and sometimes even create turbulence or air stream curl in gasses moving through the exhaust channel to lessen the efficiency of its output. The instant invention in contradistinction provides an elongate rigid exhaust tube having a smooth inner surface defining the exhaust channel and introduces pressurized air into the exhaust channel in an axially aligned medial position to establish more uniform flow lines through the channel, minimize gaseous friction adjacent channel walls and decrease curl type turbulence to increase and make more efficient air flow through the exhaust tube, maximize fume extraction and minimize power usage by the device. Additionally, though various known ventilators of the second class have been used for exhausting welding fumes from railway track systems, it appears that none have been directly concerned with the problem of accidentally creating short circuits between the opposed rails of a block of an interlocking closed track system, notwithstanding that such short-circuiting can cause catastrophic results in damaging the system.

Any portable exhaust system to be practically usable must have a length sufficient to waste extracted welding fumes efficiently and remotely from a welding area so that the fumes will not return in any deleterious concentration to the breathing environment of the welding site and such gasses must be dispersed in a direction relative to the welding site position that takes into account localized wind conditions so that exhausted fumes will not be returned to the immediate environment of the welding site by the winds. The instant ventilator resolves this problem by providing a rigid tubular dispersement tube formed of electrically non-conductive material such as polymeric or resinous plastics so that the ventilator may be positioned at a welding site without concern about its position relative to the opposed rails of a track, and may even be supported on and between the opposed rails while the rail being welded upon is carrying a high amperage welding current. The ventilator is light enough to be easily manipulatory for positioning and long enough to exhaust welding fumes at such distance and with such velocity that returns of fumes in any sufficient quantity is unlikely.

My invention does not reside in any of the foregoing features individually but rather in the synergistic combination of all of its structures, which necessarily give, rise to the functions flowing therefrom as herein specified and claimed.

SUMMARY OF INVENTION

My ventilator provides a rigid elongate dispersement tube carrying a funnel-like entry structure at a first end and defining an open orifice at a second end. A pressurized air supply pipe communicates through the dispersement tube near the joinder of the entry structure therewith to a radially medially positioned axially aligned dispersement nozzle facing the second end of the dispersement tube. An adjustable valving structure is carried in the pressurized air inlet pipe externally of the dispersement tube and preferably spacedly adjacent the point of entry of the pressurized air inlet pipe through the dispersement tube. The entry structure is preferably formed of metal that will not be damaged by the thermal environment and debris surrounding a welding site. The dispersement tube is formed of rigid electrically non-conductive material, preferably a polymeric or resinous plastic, with a length sufficient to waste fumes remotely from at a welding site.

In providing such a device it is:

A principal object to provide a portable ventilator apparatus that may be used at field welding sites for the rails of modern interlocking closed track systems and cannot transmit electric current between opposed track rails even when supported on those rails.

A further object is to provide such a ventilator that is of an elongate nature with a dispersement tube of sufficient length as to waste deleterious welding fumes at sufficient distance from the welding site that the fumes will not return in sufficient quantity to re-contaminate the welding site.

A further object is to provide such a ventilator that is powered by pressurized air introduced in the radially medially inner portion of the inner end of the exhaust channel to provide an efficient streamlined flow of exhausted air and contained deleterious gasses through the exhaust channel.

A further object is to provide such a ventilator that may be positioned with its output orifice that may be adjacent a welding site to blow smaller solid welding debris therefrom to clean the site.

A further object is to provide such a ventilator that has an exhaust channel that is defined by smooth walls and is powered by pressurized air introduced near its input end in a radially medial position to maximize efficiency of airflow therethrough by lowering gaseous friction and promoting streamline flow therethrough.

A further object is to provide such a ventilator that may be readily manipulated to orientate its exhaust orifice relative to prevailing winds to move exhausted gasses away from a welding site.

A still further object is to provide such a ventilator that is of new and novel design, of rugged and durable nature, of simple and economic manufacture and one that is well adapted for the uses and purposes for which it is intended.

Other and further objects of my invention will appear from the following specification and accompanying drawings which form a part hereof. In carrying out the objects of my invention, however, it is to be remembered that its features are susceptible of change in design an structural arrangement with only one preferred and practical embodiment of the best known mode of my invention being illustrated in the accompanying drawings and specified as is required.

BRIEF DESCRIPTION OF DRAWINGS

In the accompanying drawings which form a part hereof and wherein like number of reference refer to similar parts throughout.

DESCRIPTION OF PREFERRED EMBODIMENT

Figure 2:
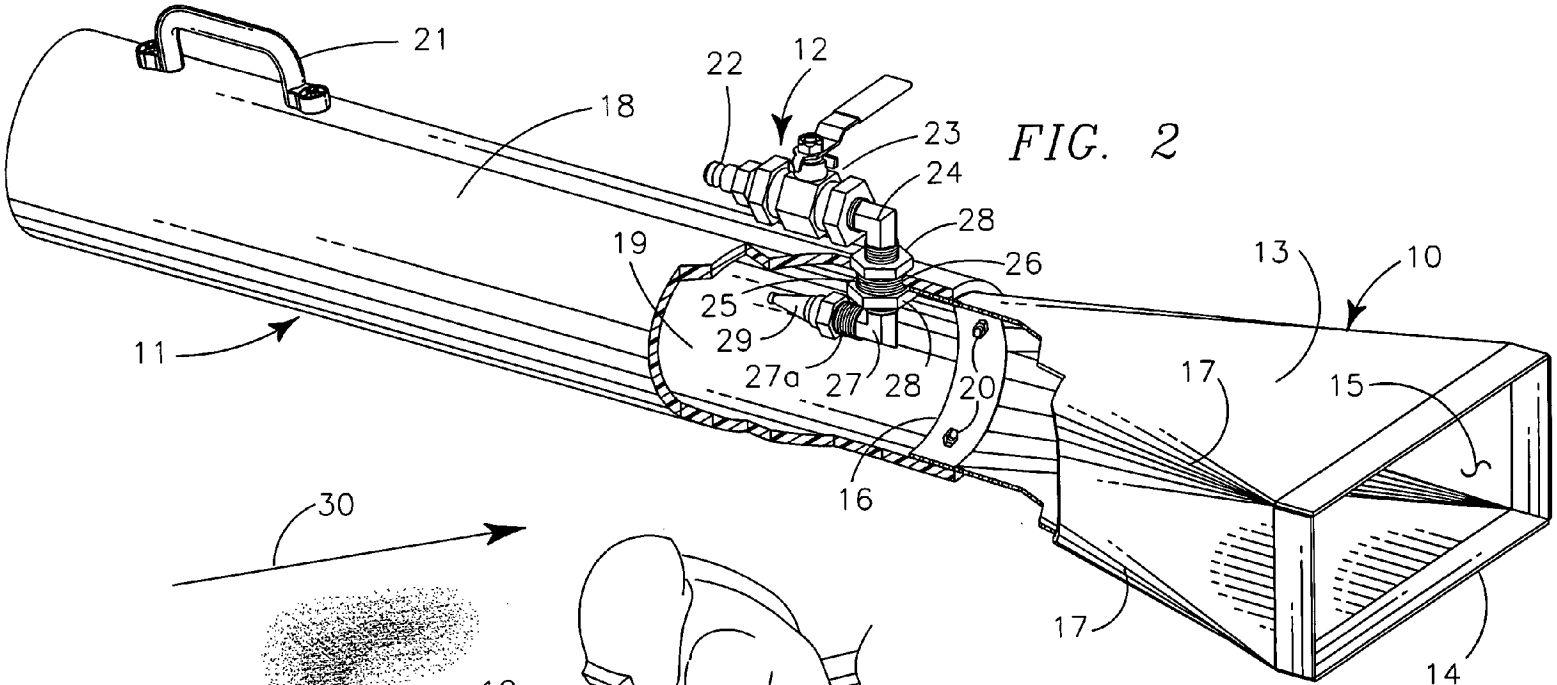
FIG. 2 is a somewhat enlarged partially cut-away isometric view of the left side and entry structure of the ventilator of FIG. 1.

My portable ventilator generally provides collection head 10 carried by dispersement tube 11 and operated by pressurized air powering structure 12.

Collection head 10 is a peripherally defined funnel-like structure 13 having areally larger rectangular rearward entry orifice structure 14 communicating by internal channel 15 to areally smaller circular forward output orifice structure 16. Preferably the funnel-like structure 13 is formed with rounded edges 17 to make a smooth transition from the linear corner edges of entry orifice 14 to the rounded edges of output orifice 16, as illustrated, so that internal channel 15 of funnel-like structure 13 is reasonably streamlined to lower fluid friction and prevent air stream curl in gasses passing through the internal channel 15. Preferably the funnel-like structure 13 is formed of thermally resistant metal to provide strength and durability and to prevent damage to the structure from hot metallic globules or other welding debris that may enter into internal channel 15 and to prevent accumulation of welding debris on the internal surfaces of channel 15. The metal funnel-like structure 13 also provides a material that has a reasonably high thermal conductivity such that through normal cooling from the ambient atmosphere thereabout and exhaust gasses passing therethrough the interior metallic surfaces will be cool enough that any welding debris or molten metallic particles entering the funnel-like structure 13 will not heat the entry structure 13 sufficiently to fuse to it and may therefore be easily removed.

Dispersement tube 11 provides elongate circularly cylindrical tube 18 defining internal channel 19. The tube 18 has an internal diameter such as will receive external diameter of output orifice structure 16 in a fastenable fit in channel 19. The funnel-like structure 13 preferably is structurally interconnected with tube 18 in a releasable fashion, in the instance illustrated by nut-bolt type fasteners 20 extending therethrough. The axially rearward portion of tube 18 defines orifice 26 to receive a power structure 12 conduit therethrough.

Tube 18 is formed of an electrically non-conductive polymeric or resinous plastic that is strong, durable and rigid. The material must also be resistant to thermal environments in which it is to be used. It has been found that thermal plastics with vicat points at or above the 220° F. range, such as various polyethylenes and polyurethanes are functional for formation of tube 18. By reason of the configuration of collection head 10 and dispersement tube 11, substantial quantities of atmospheric gasses at the temperature of the ambient atmosphere about my ventilator are drawn into the collection head 10 and through the dispersement tube 11 together with hotter gasses from about a welding site such that the temperatures of the admixed gasses passing through the dispersement tube 11 are not above the 220° F. range so as to negatively affect the structural or configurational integrity of the tube 18. To aid both the efficiency of moving air containing welding fumes from about a welding site and to adequately admix that air with the ambient atmosphere for cooling, the dispersement tube 11 preferably should have an internal diameter of approximately 3 to 8 inches and an axial length of approximately 4–6 feet. This axial length allows exhaustion of collected gasses at a distance from their point of collection such that there is quite low probability of any significant quantity of such gasses returning through the ambient atmosphere to or about the initial collection site.

If desired for manipulation purposes one or more handles 21 may be mechanically attached to the external surface of dispersement tube 11 as shown in FIG. 2. Such handles are not a necessary part of my invention though they are within its general ambit, scope and purpose.

Powering structure 12 provides a pneumatic course from connecting nipple 22 communicating through adjustment valve 23 and elbow 24 to entry nipple 25 carried in hole 26 defined through tube 18. Entry nipple 25 is internally threaded to receive the adjacent externally threaded end portion of elbow 24 externally of hole 26 in tube 18 and the externally threaded end portion of nozzle elbow 27 internally of hole 26 in the tube. Entry nipple 25 is externally threaded to receive similar nuts 28 positioned on each side of hole 26 in tube 18 to fasten the entry nipple 25 within hole 26 in tube 18. Nozzle elbow 27 is oriented with its inner forwardly extending leg 27*a* axially aligned and medially positioned within channel 19 of dispersement tube 11 and pointed away from collection head 10. The forwardly extending leg 27*a* is threaded to carry input nozzle 29. This entire pneumatic course is formed of standard gas piping fixtures of commerce and is not novel per se.

Connecting nipple 22 carries an ordinary pneumatic hose of commerce (not shown) that is supplied with pressurized air by a compressor (not shown) to provide pressurized air to ventilator the volume of which may be adjusted by adjustment valve 23 thereafter flowing to and through input nozzle 29. Preferably pressurized air is supplied through connecting nipple 22 by pneumatic hose of at least one-half inch diameter at pressure between approximately 20–100 pounds per square inch (psi). Preferably input nozzle 29 defines an output orifice 30 of approximately one-eighth inch diameter, which in a ventilator having a dispersement tube 11 of approximately three-inch diameter and an axial length of approximately five feet, will produce airflow exiting the dispersement tube 11 at a velocity of approximately sixty miles per hour or more.

Having described the structure of my ventilator its use may be understood.

Figure 1:
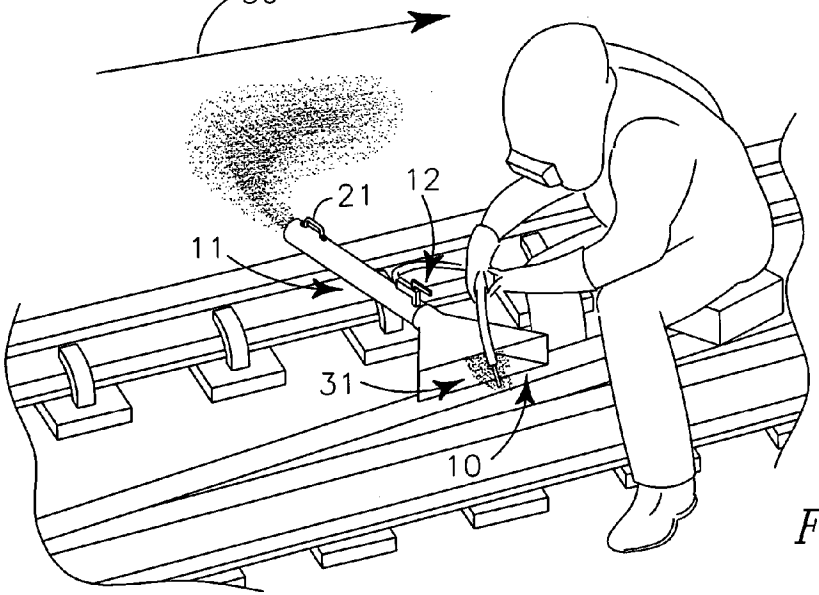
FIG. 1 is an isometric forward-looking view of my ventilator in use at a railway welding site.
Figure 4:
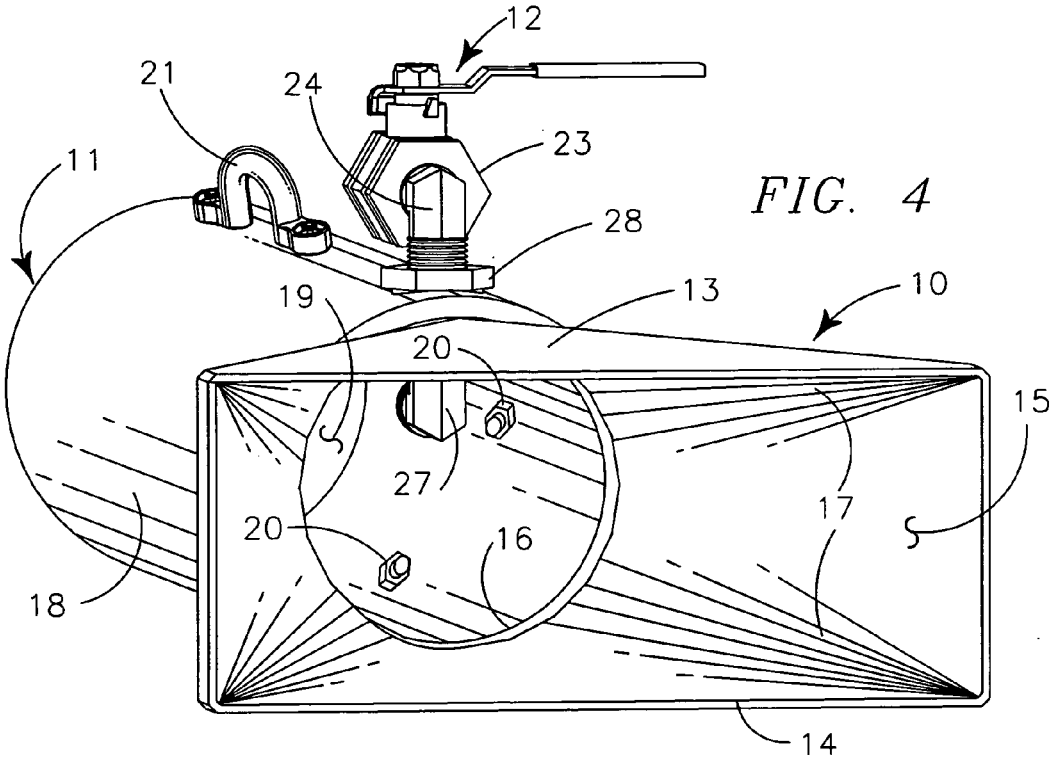
FIG. 4 is a somewhat enlarged isometric view looking forwardly through the entry structure of the ventilator of FIG. 1.
Figure 3:
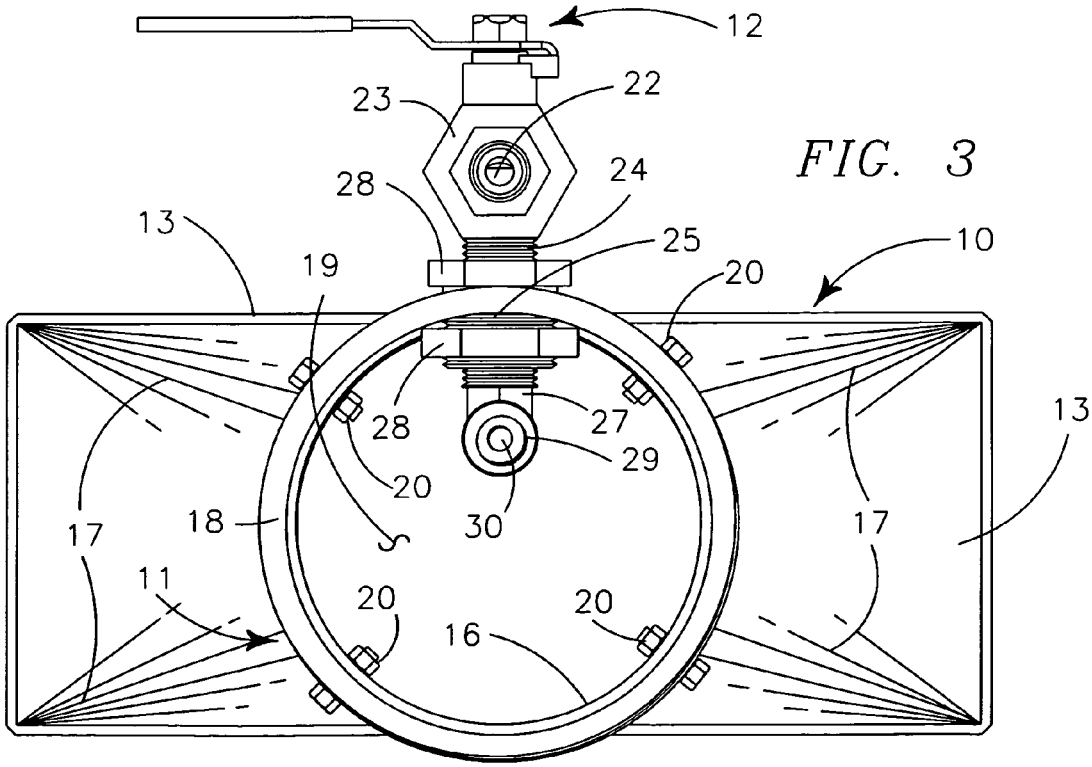
FIG. 3 is a somewhat enlarged orthographic front view of the ventilator of FIG. 1 looking down the channel of the exhaust tube.

A portable ventilator formed according to the foregoing specification is manually moved to a welding site where it is to be used. The collection head 10 of the ventilator is placed in proximity to the welding site at such a spaced distance therefrom that it will not interfere with normal welding operations and is supported on the earth or underlying structures thereon for positional maintenance. The direction of local prevailing wind is then determined, as indicated by arrowheaded line 30 in FIG. 1, and the ventilator is then oriented with its dispersement tube 11 somewhat parallel to the direction of the prevailing wind so that gaseous matter passing through the dispersement tube 11 and exiting therefrom will tend to be moved away from the welding site to be exhausted into the ambient atmosphere at a position where return to the welding site is very unlikely. It is to be noted in this regard that dispersement tube 11 may be completely supported on or between opposed rails of a track system without the possibility of the dispersement tube 11 creating an electrical circuit between those rails because of its electrically non-conducting nature.

The powering structure (not shown) is supplied with pressurized air from a separate external source such as an air compressor (not shown) through a pneumatic hose (not shown) that is interconnected with connecting nipple 22 of powering structure 12, if this interconnection is not already in existence. Pressurized air is supplied to the ventilator at a pressure of at least thirty psi and preferably approximately ninety psi. Through a standard pneumatic hose (not shown) preferably of at least one-half inch diameter. To institute ventilation, adjustment valve 23 is opened to allow pressurized air supplied through the pneumatic hose to pass through the channels defined in connecting nipple 22 elbow 24, entry nipple 25 and nozzle elbow 27 to exit through the output orifice 30 of input nozzle 29 into channel 19 of dispersement tube 11. The pressurized air exiting from input nozzle 29 will move forwardly through channel 19 of the dispersement tube 11 by reason of its velocity since the forward end of that tube is vented to the ambient atmosphere. As this occurs a negative air pressure will be established in the rearward portion of channel 19 and this will cause air at and about entry orifice 14 of collection head 10 to enter collection head 10 through the entry orifice 14 into internal channel 15 of the collection head 10 and then into channel 19 of the dispersement tube 11 to carry with it gasses and airborne deleterious material created at welding site 31 and exhausted into the ambient atmosphere about the welding site. Most of the deleterious material at and about the welding site 31 will be primarily gaseous which will intermix with the ambient atmosphere but be concentrated primarily in the immediate vicinity of the welding site 31. Some small particulate debris commonly generated at the welding site 31 that remain airborne in the atmosphere about the welding site for an appreciable period of time, will be moved by my ventilator through its exhaust channel to pass out of forward orifice of dispersement tube 11. Such particulate debris will be partially cooled by surrounding gasses before and during passage through channel 19 of dispersement tube 11 and exhausted with some velocity from the dispersement tube 11 to be further cooled after exiting the dispersement tube 11 so that the particulate material will be sufficiently cooled that it is unlikely it could start fires at or about the dispersement area. In this regard it is to be noted that only smaller and less massive particles will move through dispersement tube 11. Larger and heavier particles that might not be cooled during passage through dispersement tube 11 will probably move downward by reason of gravitational forces to be deposited before entering the ventilator collection head 10 and or if they do enter the ventilator such particles probably will be deposited within the collection head 10 especially as aided by reason of the small vertical dimension of collection head 10.

In using my ventilator it has been found that if pressurized air is supplied through a half-inch pneumatic conduit to powering structure 12 having ordinary half-inch pneumatic pipe fixtures and input into dispersement tube 11 through an input nozzle 29 having a 0.17 inch circular output orifice 30 carried in a smooth walled internal channel 15 defined by a three inch internal diameter dispersement tube 11 59.5 inches long, with gas supplied at gage pressure of 90 psi, the discharge flow will be approximately 90 mph as determined by a standard anemometer gage. Based on the immediately foregoing parameters of the exhaust system the gas flow at the discharge end of the collection tube is approximately 354.5 $ft^3$/min with a velocity of 124 ft/sec. Airflow at the orifice of the input nozzle is approximately 40 $ft^3$/min with a velocity of approximately 4295.5 ft/sec.

Exhaustion of gasses from my ventilator with such parameters has been found quite effective at ordinary open welding sites to remove deleterious gasses and smaller particulate matter, though the parameters may vary substantially to accommodate particular conditions and such variant parameters are within the ambit and scope of my invention. Environmental tests with the instant ventilator showed that the occupational exposure to welding fumes for compounds detected and regulated by existing standards was dramatically lower when the ventilator was used than when it was not used. In general a worker using the instant ventilator was exposed to 50 times less manganese and 21 times less iron than occurred if the ventilator was not used. A comparison of exposures to various metals associated with the electric arc welding process and regulated as occupational hazards in welding environments with and without the use of the instant ventilator is set forth in Table 1, as based on long term working environment exposure.

TABLE 1

| | | Occupational Exposure To Welding Fumes Longer Term Exposure | | | | |
|---|---|---|---|---|---|---|
| | WISHA PEL ($mg/m^3$)[1] | OSHA PEL ($mg/m^3$)[1] | Occupational Exposure With Ventilator (Sample A102) ($mg/m^3$) | Occupational Exposure Without Ventilator (Sample A107) ($mg/m^3$) | Occupational Exposure With Ventilator Percent of OSHA PEL | Occupational Exposure Without Ventilator Percent of OSHA PEL |
| Aluminum | 5.0 | 15.0 | BDL[3] | 0.019 | N/A | 0.13% |
| Cadmium | 0.005 | 0.005 | BDL[3] | BDL[3] | N/A | N/A |
| Chromium | 0.5 | 1.0 | BDL[3] | 0.021 | N/A | 2.1% |
| Copper | 0.1 | 0.1 | BDL[3] | BDL[3] | N/A | N/A |
| Iron | 5.0 | 10.0 | 0.013 | 0.28 | 0.13% | 2.8% |
| Manganese | 1.0 | 5.0 | 0.021 | 1.1 | 0.42% | 22%[4] |
| Nickel | 1.0 | 1.0 | BDL[3] | BDL[3] | N/A | N/A |
| Zinc | 5.0 | 5.0 | BDL[3] | BDL[3] | N/A | N/A |

[1]Washington Industrial safety and Health Act (WISHA), as administered by the Washington State Department of Labor and Industries. Permissible Exposure Limits (PEL) as established in WAC 296-155-160 and WAC 296-62-07515. Cadmium PEL as established in WAC 296-62-074. PELs in milligrams per cubic meter of air ($mg/m^3$).
[2]US Department of Labor, Occupational Safety and Health Administration (OSHA), Permissible Exposure Limits (PEL) as established in 29 CFR 1910.1000, Table Z-1. Cadmium PEL as established in 29 CFR 1926.1127 and 1910.1000 Table Z-2. PELs in milligrams per cubic meter of air ($mg/m^3$).
[3]Weight of compound in the sample was below the laboratory detection limits (BDL).
[4]Under the scenario tested and assumptions made, the sampling results for manganese indicated a time weighted average (TWA) in exceedance of WISHA/PEL.

The foregoing embodiment of my invention is illustrated and described in detail, but it is to be understood that the invention is not limited thereto or thereby, but its scope is defined only by the following claims.

What I desire to protect by Letters Patent, and what I claim is:

1. A portable apparatus for removing deleterious gasses and airborne particulate material from an electric welding site on an interlocking closed track railway system without disabling the system, comprising in combination:

a peripherally defined funnel-like collection head having a first end defining an areally larger input orifice and a second end defining an areally smaller output orifice;

an electrically non-conductive, configurationally sustaining dispersement tube having a medial channel defined by a smooth lineally elongate ruled surface with a first output end and a second input end structurally carrying the second end of the collection head;

powering structure carried by the dispersement tube and extending into the medial channel defined thereby, said powering structure having;

a connecting nipple for interconnection to an external source of pressurized non-combustible gas, an adjustment valve to regulate flow of pressurized non-combustible gas to an input nozzle, an input nozzle carried in the medial channel defined by the dispersement tube to disburse pressurized gas in a direction toward the first output end of the dispersement tube, conduits pneumatically interconnecting the connecting nipple, the adjustment valve and the input nozzle; and means for supplying pressurized gas to the connecting nipple.

2. The apparatus of claim 1 wherein:

the input nozzle is positioned in a substantially axially aligned position in the medial channel defined by the dispersement tube spacedly inwardly adjacent the second input end of the dispersement tube.

3. The apparatus of claim 2 wherein:

the second end of the collection head fits in a slip joint within the medial channel defined by the dispersement tube at the second input end of the dispersement tube to create a venturi effect in the channel of the dispersement tube.

4. A portable ventilator for removing deleterious gasses and airborne particulate matter from an electric welding site on an interlocking closed track railway system without disabling the system, comprising in combination:

a peripherally defined funnel-like collection head formed of thermally resistant metal and having a first end defining an areally larger input orifice and a second end defining an areally smaller output orifice with a smooth transition surface defining a channel therebetween;

a rigid electrically non-conductive elongate cylindrical dispersement tube having a medial channel defined by a smooth surface, a first output end and a second input end structurally carrying the second end of the collection head;

powering structure carried by the dispersement tube and extending into the medial channel defined by the dispersement tube, said powering structure having:

a connecting nipple for connection with an external source of pressurized air, an adjustment valve to regulate flow of pressurized air through the connecting nipple, an input nozzle carried in axial alignment in the medial channel defined by the dispersement tube to disburse pressurized air therefrom in a direction toward the first output end of the dispersement tube, and conduits pneumatically interconnecting the connecting nipple, the adjustment valve and the input nozzle, said powering structure being spacedly adjacent the second end of the collection head and electrically isolated therefrom; and means for supplying pressurized air through the connecting nipple.

5. The portable ventilator of claim 4 further characterized by:

the dispersement tube formed of polymeric plastic and having a circularly cylindrical configuration of substantially 3 inch internal diameter and a length of approximately 60 inches;

the input nozzle having a circular output orifice of approximately 0.17 inch; and the pressurized air supplied through the connecting nipple having a pressure of approximately 90 pounds per square inch.

* * * * *